US005478265A

United States Patent [19]

Matsutani et al.

[11] Patent Number: 5,478,265

[45] Date of Patent: Dec. 26, 1995

[54] SPARK PLUG AND A METHOD OF MAKING OF SAME

[75] Inventors: Wataru Matsutani; Junichi Kagawa, both of Nagoya, Japan

[73] Assignee: NGK Spark Plug Co., Ltd., Nagoya, Japan

[21] Appl. No.: 391,022

[22] Filed: Feb. 21, 1995

Related U.S. Application Data

[62] Division of Ser. No. 105,611, Aug. 13, 1993.

[30] Foreign Application Priority Data

Aug. 19, 1992 [JP] Japan ..... 90-220044

[51] Int. Cl.[6] ..... H01T 21/02

[52] U.S. Cl. ..... 445/7; 219/121.64

[58] Field of Search ..... 445/7; 219/121.64

[56] References Cited

U.S. PATENT DOCUMENTS 4,963,112 10/1990 Benedikt et al. ..... 445/7
5,273,474 12/1993 Oshima et al. ..... 445/7
5,320,569 6/1994 Oshima et al. ..... 445/7

FOREIGN PATENT DOCUMENTS 57-151183 9/1982 Japan .
62-31797 7/1987 Japan .
63-57919 11/1988 Japan .
2500704 3/1990 Japan .

*Primary Examiner*—P. Austin Bradley
*Assistant Examiner*—Jeffrey Todd Knapp
*Attorney, Agent, or Firm*—Sughrue, Mion, Zinn, Macpeak & Seas

[57] ABSTRACT

In a spark plug including a cylindrical metallic shell having an insulator in which a center electrode is placed, a front end of which somewhat extends beyond the insulator, a noble metal portion is bonded to an outer side wall of the front end of the center electrode by means of laser beams so as to form a spark gap between the noble metal portion and a ground electrode which is depended from the metallic shell. The noble metal portion has a molten alloy layer in which the center electrode is melted into the noble metal portion, and a diffused alloy layer in which the noble metal portion is diffused into the center electrode.

3 Claims, 9 Drawing Sheets

SPARK PLUG AND A METHOD OF MAKING OF SAME

This is a divisional of Application No. 08/105,611 filed Aug. 13, 1993.

BACKGROUND OF THE INVENTION

1. Field of the Invention

This invention relates to a spark plug and a method of making the spark plug in which a spark-erosion resistant noble metal is secured to a front end of a center electrode.

2. Description of Prior Art

In a spark plug for an internal combustion engine, a noble metal tip is welded to a front end of a center electrode or a discharge end of a ground electrode so as to increase a spark-erosion resistant property. The noble metal tip is usually made of Pt, Pd, Ir or alloys with these metals as main components. The tip is bonded to the electrode by means of electric resistance welding, and then the tip is extruded together with the front end of the center electrode as shown in Japanese Patent Application Publication No. 62-31797.

The electric resistance welding forms a diffused alloy layer in which the noble metal is diffused into the front end of the center electrode. Considering that the center electrode is made of a nickel-based alloy, a stress concentration occurs at an interface between the noble metal tip and the front end of the center electrode due to a repetitive thermal stress caused by thermal expansional difference therebetween when the center electrode is repeatedly exposed to the heat-cool cycle in a combustion chamber.

For this reason, there arises a possibility of developing cracks at the interface between the tip and the center electrode to break the tip off the center electrode when the cracks sufficiently grow.

Therefore, it is one of the objects of the invention to provide a spark plug and a method of making the spark plug in which a noble metal portion is positively secured to an outer side wall of a front end of a center electrode by means of laser beams so as to prevent the noble metal portion from inadvertently peeling off the center electrode, and thus contributing to an extended service life with relatively low cost.

SUMMARY OF THE INVENTION

According to the invention, there is provided a spark plug including a cylindrical metallic shell having an insulator in which a center electrode is placed, a front end of which somewhat extends beyond the insulator, a noble metal portion is bonded to an outer side wall of the front end of the center electrode by means of laser beams so as to form a spark gap between the noble metal portion and a ground electrode which is depended from the metallic shell. The noble metal portion has a molten alloy layer in which the center electrode is melted into the noble metal portion, and a diffused alloy layer in which the noble metal portion is diffused into the center electrode. The molten alloy layer of the noble metal portion contains a component of the center electrode in the range of 0.5~80.0% by weight.

The provision of the molten alloy layer makes it possible to decrease the thermal stress between the noble metal portion and the center electrode, and preventing the growth of cracks so as to protect the noble metal portion from peeling off the center electrode when the center electrode is repeatedly exposed to the heat-cool cycle in a combustion chamber.

These and other objects and advantages of the invention will be apparent upon reference to the following specification, attendant claims and drawings.

DETAILED DESCRIPTION OF THE EMBODIMENTS

Figure 1:
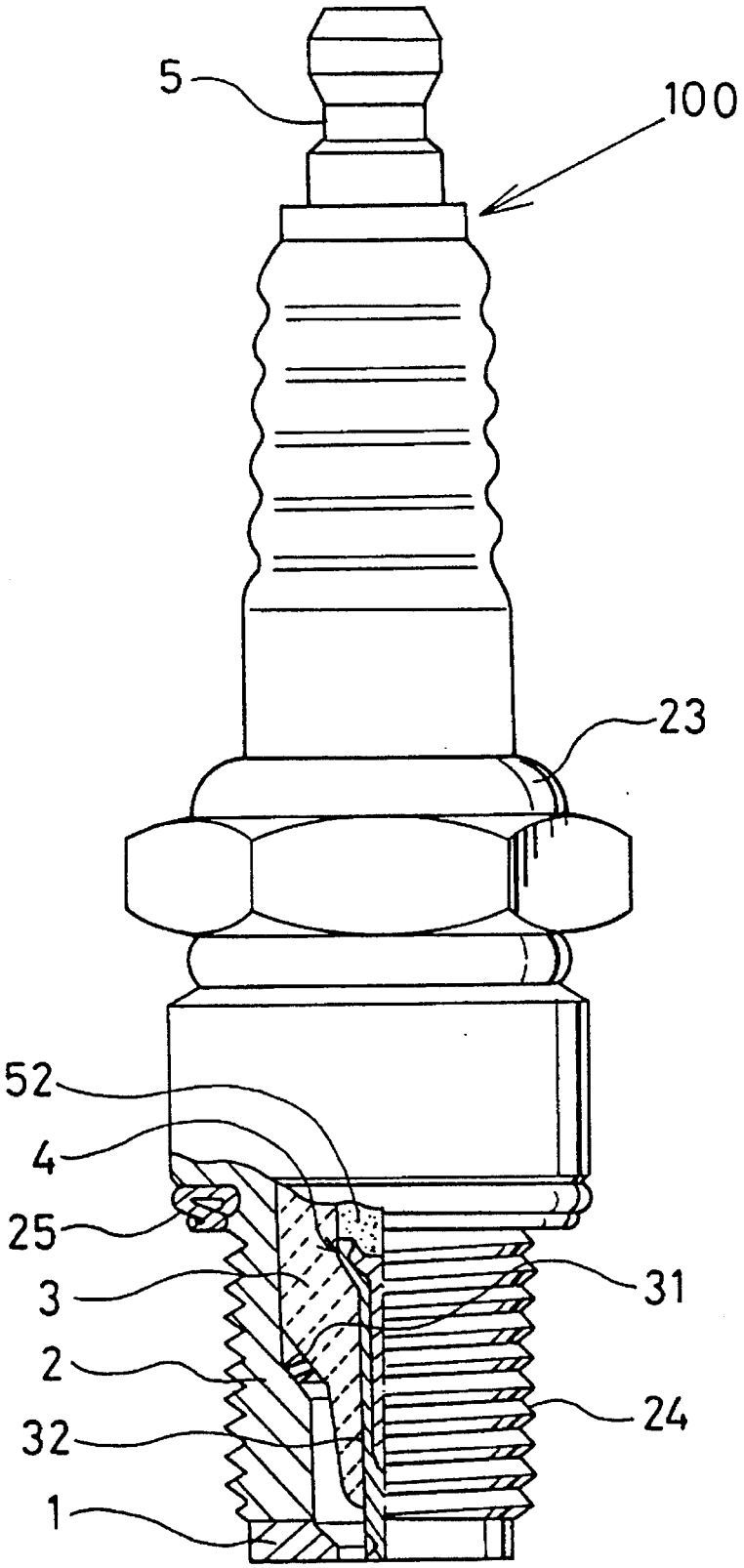
FIG. 1 is a plan view of a spark plug in partial section.
Figure 2:
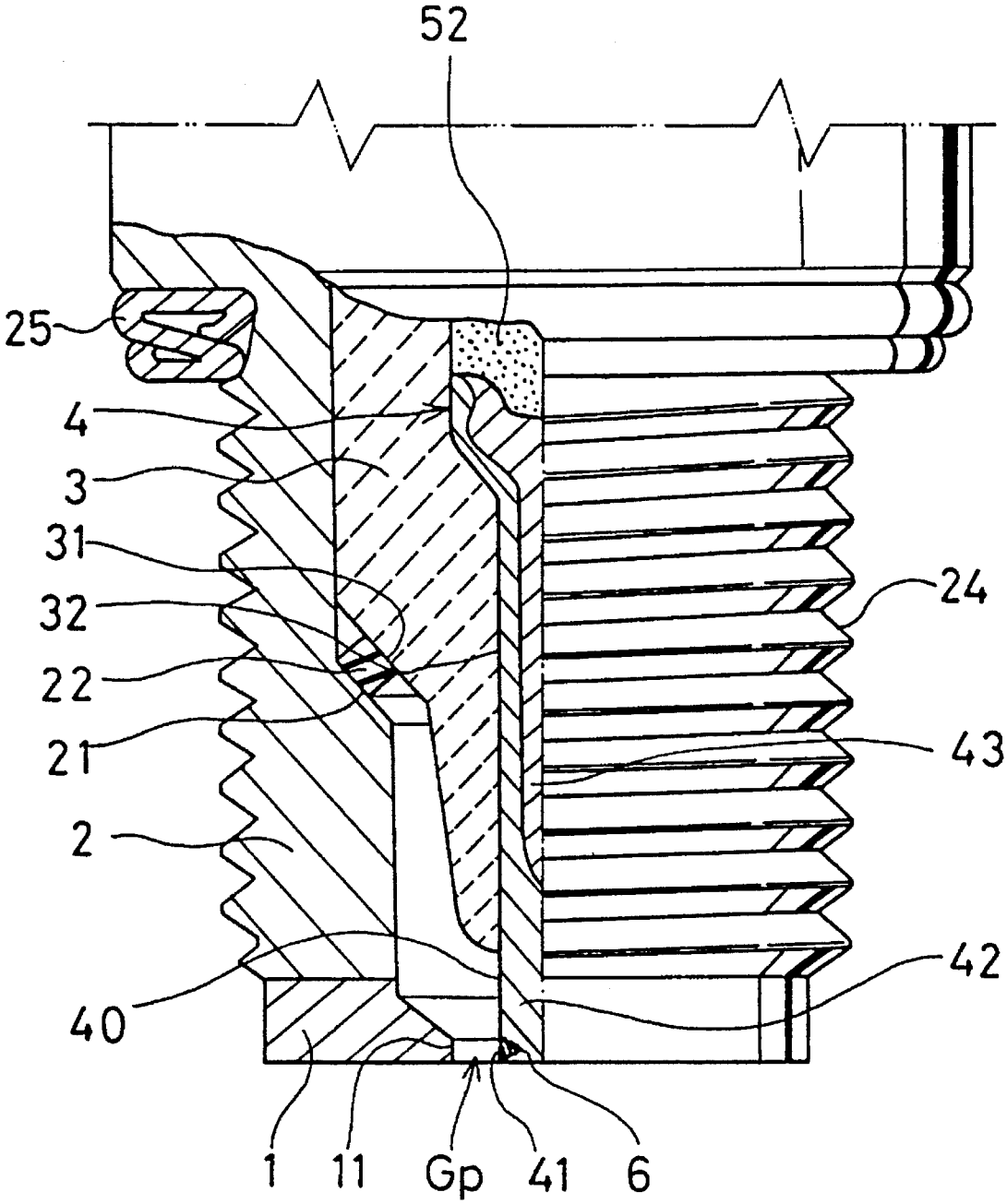
FIG. 2 is an enlarged longitudinal cross sectional view of the front portion of the spark plug.

Referring to FIG. 1 which shows a spark plug 100 according to a first embodiment of the invention, the spark plug 100 has a cylindrical metallic shell 2, to a front end of which a ground electrode 1 is secured by means of welding. Within the metallic shell 2, a tubular insulator 3 is concentrically supported through a packing 22 by resting a stepped portion 31 of the insulator 3 on a shoulder portion 21 which is provided with an inner wall of the metallic shell 2 as shown in FIG. 2. The metallic shell 2 has a rear head 23 turned in to engage on the insulator 3 by means of caulking so as to secure the insulator 3 against removal.

An inner space of the insulator 3 serves as an axial bore 32 in which a center electrode 4 is placed. A front end of the center electrode 4 extends somewhat beyond the insulator 3 to be in flush with the front end of the ground electrode 1, and at the same time, forming a spark gap (Gp) with the ground electrode 1 through a noble metal portion 6 described hereinafter in detail. The center electrode 4 and a terminal electrode 5 are heat sealed in the insulator 3 by an electrically conductive glass sealant 52. The spark plug 100, thus structured, is secured to a cylinder head of the internal combustion engine by way of a gasket 25 and a threaded portion 24 provided at an outer surface of the metallic shell 2.

The center electrode 4 has a composite column 40 including a clad metal 42 and a heat-conductive core 43 embedded in the clad metal 42. The clad metal 42 is made of a nickel-based alloy including 8.0% iron (Fe) and 15.0% chromium (Cr), while the heat-conductive core 43 is made of an alloyed metal with a copper (Cu) or silver (AG) as a main component. To an outer wall 41 of the front end of the composite column 40, the noble metal portion 6 is provided to form the spark gap (Gp) with a discharge end 11 of the ground electrode 1. The ground electrode 1 is made of a nickel-based alloy including chromium (Or) and iron (Fe). In this instance, the ground electrode 1 may be made in integral with the metallic shell 2.

The noble metal portion 6 is made of a noble metal material 60 such as platinum (Pt), iridium (Ir), Pt-Ir alloy, Pt-Ni alloy or Ir-alloy including oxides of rare earth metals.

Figure 3A:
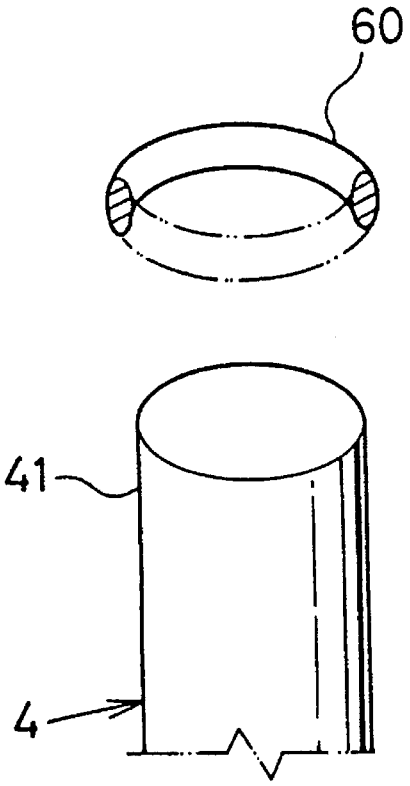
FIGS. 3*a* and 3*b* are perspective views of a front end of a center electrode to show how a noble metal portion is welded to the center electrode according to a first embodiment of the invention.

The noble metal material 60 is welded to the composite column 40 of the center electrode 4 as follows:

(i) The noble metal material 60 is prepared into a ring-shape configuration, an inner diameter of which is substantially the same as an outer diameter of the noble composite column 40. Then, the ring 60 is inserted to the outer side wall 41 the composite column 40 of the center electrode 4, and provisionally held in place by an appropriate means as shown in FIG. 3*a*.

Figure 3B:
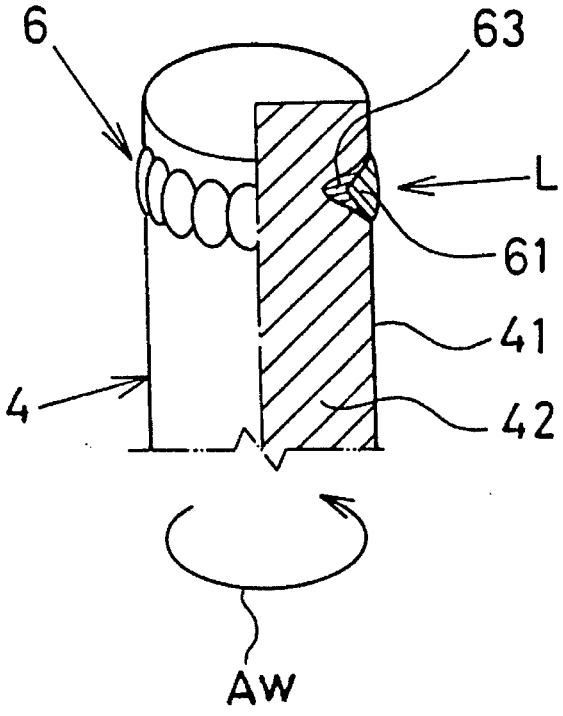

(ii) As shown in FIG. 3*b*, the laser beam welding is carried out by using YAG (yttrium, aluminum and garnet) laser beams (L), emitted at 10 mm underfocus with one shot energy and pulse duration as 6.5 Joules and 2.0 milliseconds respectively.

Figure 4:
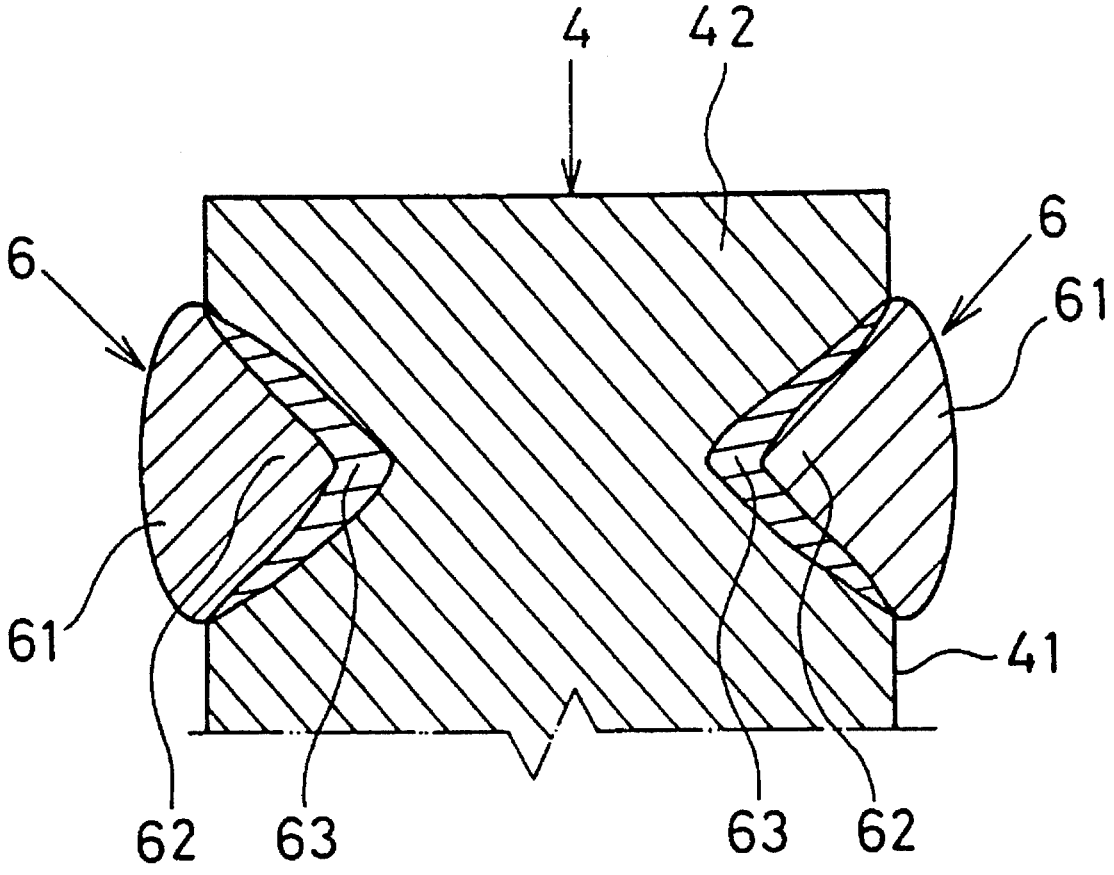
FIG. 4 is an enlarged longitudinal cross sectional view of the front end of the center electrode.

The laser beams (L) are intermittently applied in several shots perpendicular to the noble metal ring 60 while rotating the composite column 40 of the center electrode 4 in a direction shown at arrow (Aw) in FIG. 3*b*. The laser beams (L) make it possible to melt the noble metal ring 60 and the outer side wall 41 of the composite column 40 simultaneously to form the sash-like noble metal portion 6. The noble metal portion 6 includes a molten alloy layer 61 in which a component of the clad metal 42 of the composite column 40 is thermally fused into the noble metal ring 60, and a diffused alloy layer 63 in which the noble metal ring 60 is diffused into the outer side wall 41 of the clad metal 42 of the composite column 40 between the molten alloy layer 61 and the clad metal 42 of the composite column 40 as shown in FIG. 4. The molten alloy layer 61 contains the component of the clad metal 42 in the range of 0.5~80.0% by weight. The diffused alloy layer 63 has a width extending from several μm to several hundreds μm.

In the diffused alloy layer 63, the diffused degree of the noble metal progressively decreases as the layer 63 is away from a base end 62 of the molten alloy layer 61. The component of the clad metal 42 is melted into the base end 62 of the molten alloy layer 61 so that the thermal expansional coefficient of the base end 62 approaches to that of the clad metal 42. With the formation of the diffused alloy layer 63 and the base end 62 of the molten alloy layer 61, it is possible to prevent the thermal stress from locally working on the welded portion when the center electrode is exposed to the repeated heat-cool cycle. It also decreases the thermal stress itself by reducing the differing degree of the thermal expansional coefficient in the direction from the welded portion to the clad metal 42. This makes it possible to prevent the Growth of cracks at the welded portion or in the proximity of the welded portion so as to avoid the molten alloy layer 61 from peeling off the outer side wall 41 of the clad metal 42.

Figure 5A:
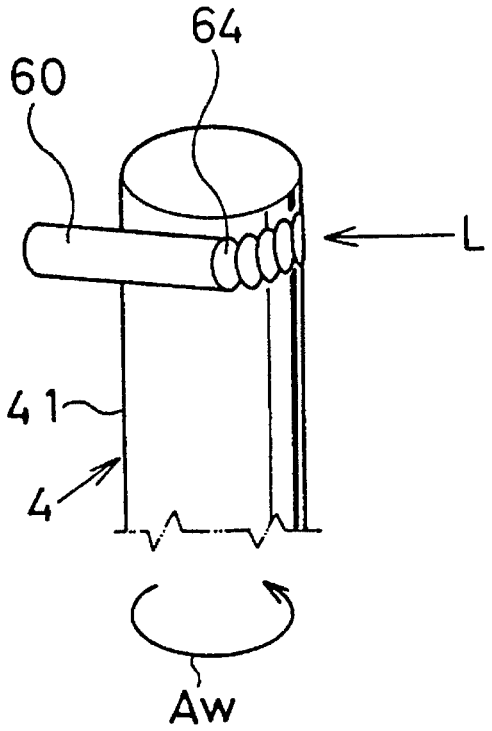
FIGS. 5*a* and 5*b* are perspective views of a front end of a center electrode to show how a noble metal portion is welded to the center electrode according to second and third embodiments of the invention.
Figure 5B:
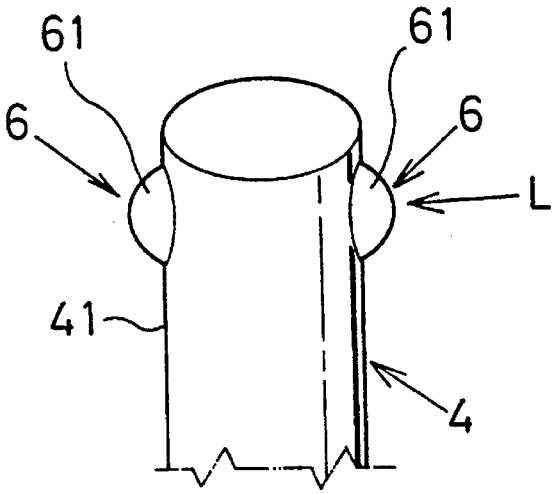

FIGS. 5*a* and 5*b* in turn show second and third embodiments of the invention.

As shown in FIG. 5*a*, the noble metal material 60 is in the form of wire according to the second embodiment of the invention. A leading end 64 of the noble metal wire 60 is placed around the outer side wall 41 of the front end of the composite column 40 while applying the laser beams (L) to the leading end 64 so as to form the annular noble metal portion 6 all around the outer side wall 41 in the same manner as described in the first embodiment of the invention. In this instance, the rotation of the composite column 40 accompanies with the laser beam welding operation. The use of the noble metal wire 60 eliminates the necessity of forming the noble metal material into the ring-shape configuration, and obviating the provisionally holding the noble metal wire 60 in place at the time of welding it to the outer wall 41 of the composite column 40, thus making it possible to advantageously reduce the number of assemble processes.

In the second embodiment of the invention, the leading end 64 of the noble metal wire 60 is intermittently laser-welded to the outer side wall 41 of the composite column 40 to form the bead-like noble metal portion 60 as shown in FIG. 5*b*. In this instance, the laser beams (L) are shot so that the number of the beads of the noble metal portion 60 corresponds to that of ground electrodes with the orientation of the ground electrodes considered. Instead of the noble metal wire 60, the noble metal material may be in the form of a spherical or cone-shaped nugget, and the noble metal nugget may be provisionally held in place at the outer side wall 41 of the composite column 40 by means of electric resistance welding before the nugget is substantially laser-welded to the outer side wall 41 of the composite column 40. The use of the noble metal nugget reduces an amount of noble metal so as to contribute to cost-saving.

Figure 6:
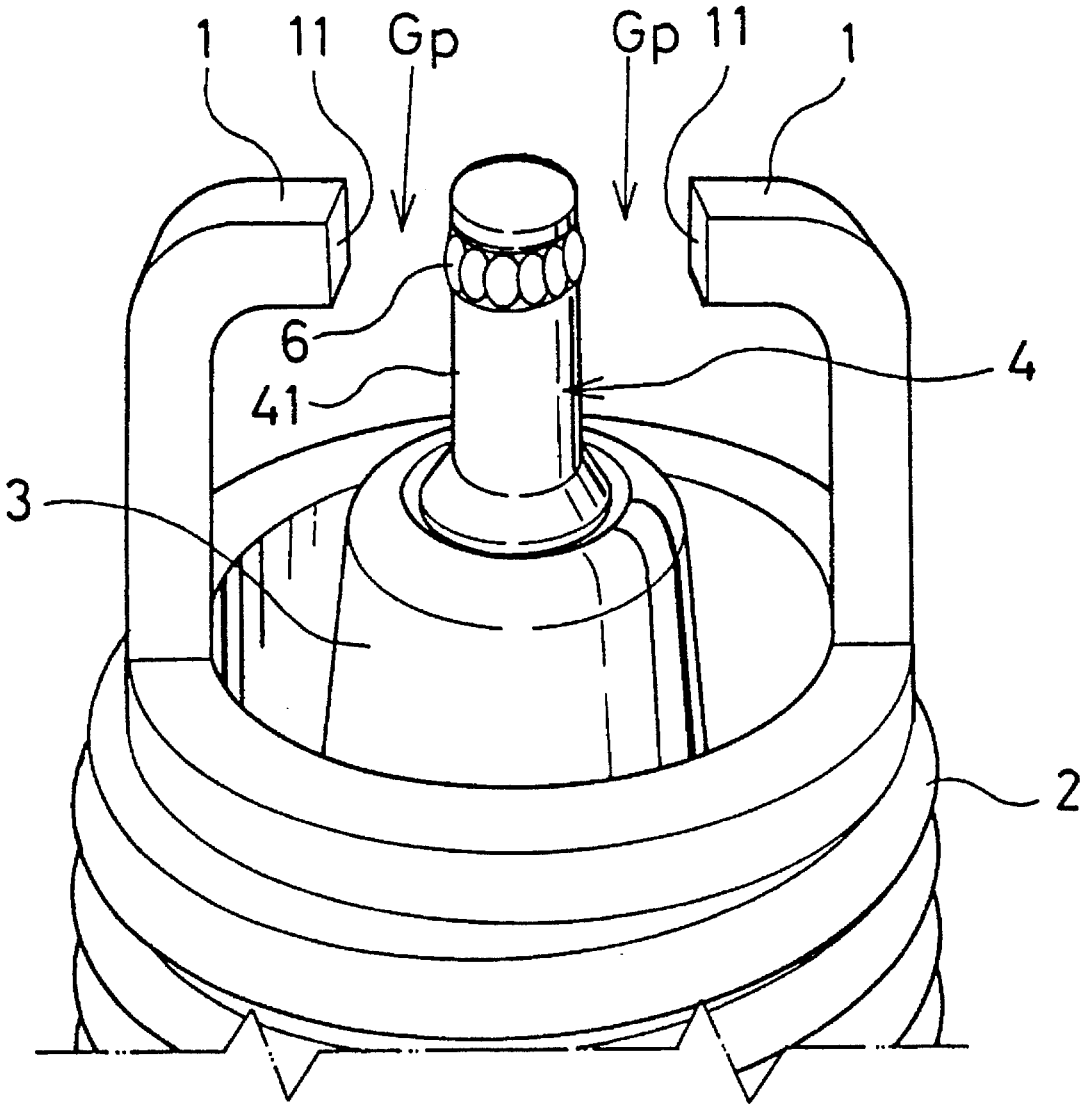
FIG. 6 is an enlarged longitudinal cross sectional view of a firing end of the spark plug according to a fourth embodiment of the invention.

FIG. 6 shows a fourth embodiment of the invention in which the diametrically opposed ground electrodes 1 project into a combustion chamber of the internal combustion engine. The noble metal material 60 is laser-welded to the outer side wall 41 of the composite column 40 to be in registration with a discharge end 11 of the ground electrode 1 so as to form the noble metal portion 6.

Figure 7A:
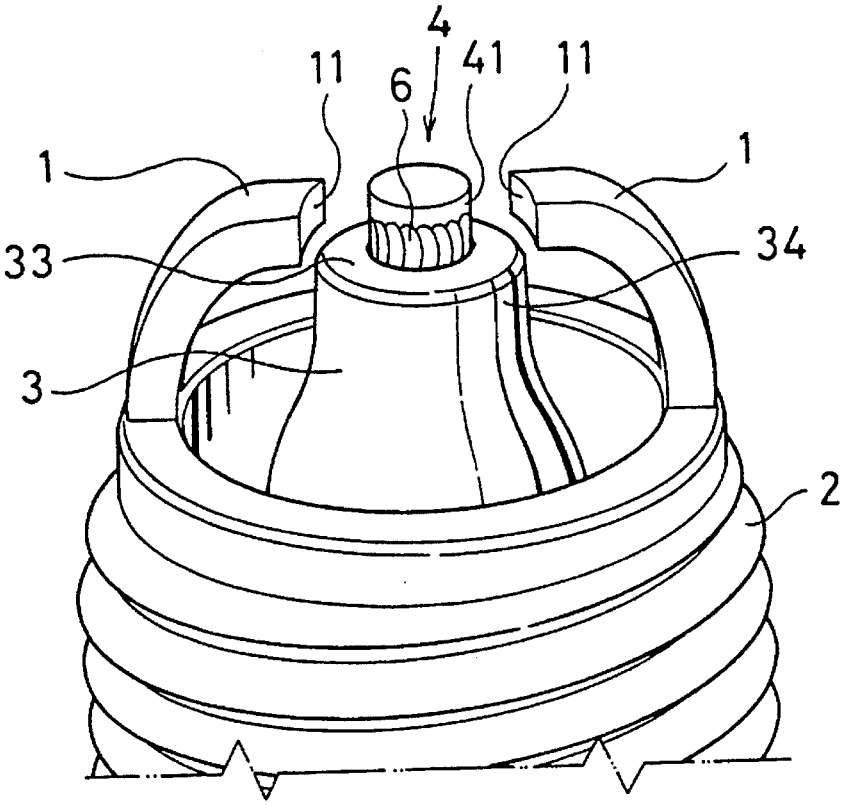
FIG. 7*a* is an enlarged perspective view of a firing end of the spark plug according to a fifth embodiment of the invention.
Figure 7B:
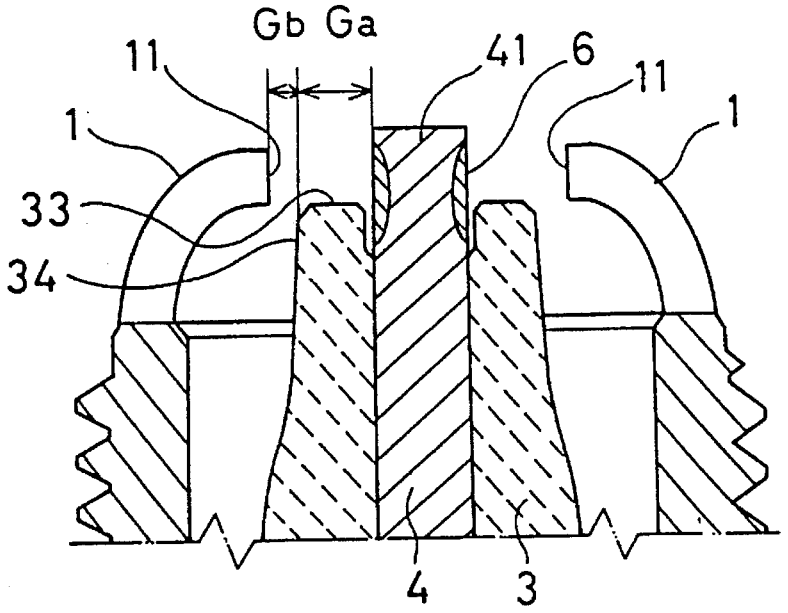
FIG. 7*b* is an enlarged longitudinal cross sectional view of a firing end of the spark plug according to a fifth embodiment of the invention.

FIGS. 7*a* and 7*b* show a fifth embodiment of the invention in which a surface discharge gap (Ga) and an air gap (Gb) are provided in a semi-surface-discharge type spark plug. The noble metal material 60 is laser-welded to the outer side wall 41 of the composite column 40 to provide the noble metal portion 6. The surface-discharge gap (Ga) is a distance measured along a discharge-surface 33 between an noble metal portion 6 and an outer surface of the insulator 3. The air gap (Gb) is a distance between an outer surface 34 of the insulator 3 and the discharge end 11 of the ground electrode 1 as shown in FIG. 7*b*.

Figure 8:
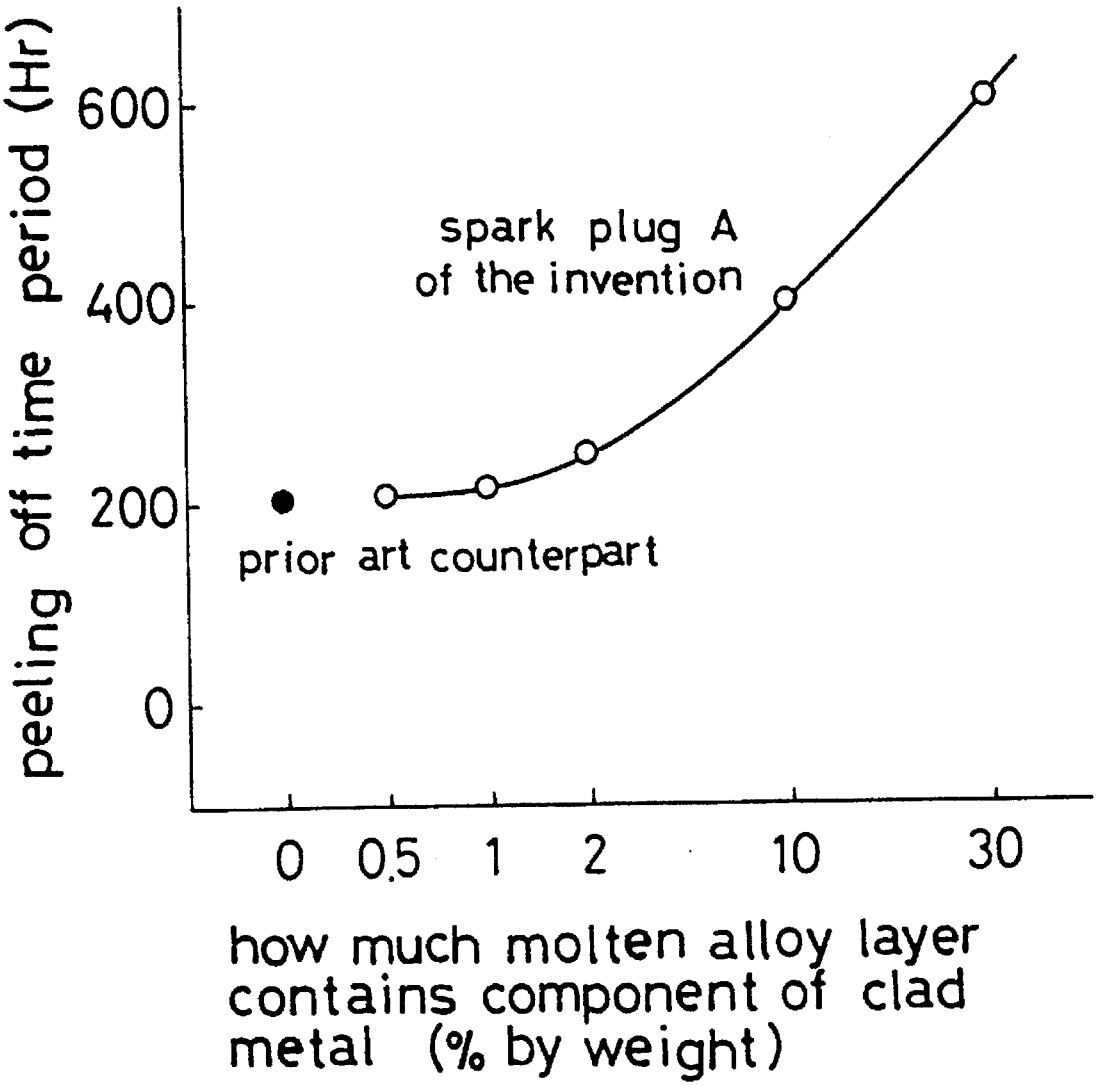
FIG. 8 is a graph showing how an endurance time period changes depending on how much the center electrode component is melt into the noble metal portion.

FIG. 8 is a graph showing how many hours are required for the noble metal portion 6 to peel off the clad metal 42 depending on how much the molten layer 61 contains the component of the clad metal 42. The graph is obtained after carrying out an endurance heat-cool cycle alternately between a full throttle (5000 rpm) for 1 min. and an idle operation for 1 min. with a spark plug (A) and a prior art counterpart mounted on an internal combustion engine (six-cylinder, 2000 cc) respectively. In the prior art counterpart, a noble metal portion is provided by means of electric resistance welding.

It is found from FIG. 8 that it takes much longer for the noble metal portion 6 to peel off the outer side wall 41 compared to prior art counterpart when the alloy layer 61 contains the component of the clad metal 42 more than 0.5% by weight.

Figure 9:
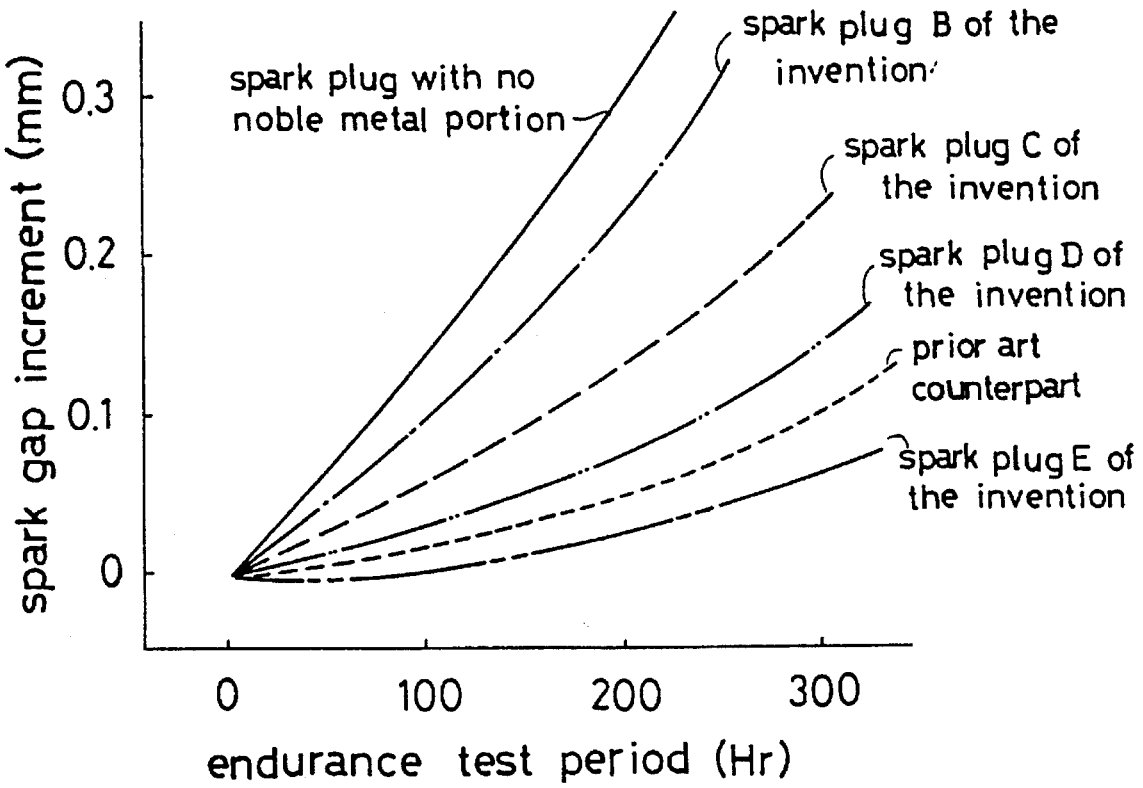
FIG. 9 is a graph showing how a spark gap increment changes depending on how much the center electrode component is melted into the noble metal portion with over time.

FIG. 9 is a graph showing how the spark gap increment changes depending on how much the molten layer 61 contains the component of the clad metal 42. The graph is obtained after carrying out an endurance test at full throttle (5500 rpm) with spark plugs (B)~(D) mounted on an internal combustion engine (four-cylinder, 1600 cc) respectively.

In the spark plugs (B)~(D), the molten alloy layer 61 in turn contains the component of the clad metal 42 by 90%, 80%, 20% and 10% by weight.

It is found from the endurance test that the spark gap increment augments to accelerate the spark erosion of the clad metal 42 when the molten alloy layer 61 contains the component of the clad metal 42 excessively.

Although a relatively small amount of the spark erosion is maintained in the prior art counterpart in which the noble metal tip is provided by means of electric resistance welding, it is possible to control the spark erosion by selecting the kind of the noble metal material 60 and the shooting condition of the laser beams (L) as shown at the spark plug (E) in FIG. 9. With the use of the ,noble metal portion 6, its flake-resistant property is significantly improved with relatively low cost as evidenced by FIG. 8, it is sufficiently enough to put the spark plug into practical use as long as the molten alloy layer 61 contains the component of the clad metal 42 by 80% or less.

As apparent from the foregoing description, the noble metal portion 6 has the molten alloy layer 61 which contains the component of the clad metal 42, thus making it possible to effectively prevent the development and growth of the cracks at the welding portion or in the neighborhood of the welding portion so as to conductive to a long service life.

It is noted that the insulator 3 may be made by ceramic material with magnesia as a main component.

Further, it is also appreciated that the ground electrode 1 may be made of a composite column in which a copper core is embedded in a clad metal in the same manner as the center electrode 4 is assembled in the embodiment of the invention.

While the invention has been described with reference to the specific embodiments, it is understood that this description is not to be construed in a limiting sense in as much as various modifications and additions to the specific embodiments may be made by skilled artisan without departing from the spirit and scope of the invention.

What is claimed is:

1. In a method of making a spark plug comprising a cylindrical metallic shell having a tubular insulator in which a columnar center electrode is placed, a front end of which extends beyond the insulator, and including a noble metal portion bonded to an outer wall of the front end of the center electrode so as to form a spark gap between the noble metal portion and a ground electrode which extends from the metallic shell:

the method of making the spark plug comprising steps of:

placing a noble metal wire or nugget on a center electrode;

applying laser beams to the noble metal wire or nugget to form a noble metal portion at an outer side wall of the front end of the center electrode, the laser beams being emitted several times with one shot energy of 6.5 Joules so as to form a molten alloy layer in which a portion of the center electrode is melted into the noble metal portion, and to form a diffused alloy layer in which a portion of the noble metal is diffused into the center electrode.

2. A method of making a spark plug as recited in claim 1, wherein the molten alloy layer of the noble metal portion contains a component of the center electrode in the range of 0.5~80.0% by weight.

3. A method of making a spark plug as recited in claim 1, wherein the noble metal portion of the noble metal portion is in the form of a sash or bead configuration all around the outer side wall of the front end of the center electrode.

* * * * *